US009768484B2

(12) United States Patent
Puoskari et al.

(10) Patent No.: US 9,768,484 B2
(45) Date of Patent: Sep. 19, 2017

(54) RESONATOR STRUCTURE FOR A CAVITY FILTER ARRANGEMENT

(71) Applicant: Intel Corporation, Santa Clara, CA (US)

(72) Inventors: Jukka Puoskari, Tupos (FI); Petri Päri, Los Angeles, CA (US)

(73) Assignee: Intel Corporation, Santa Clara, CA (US)

( * ) Notice: Subject to any disclaimer, the term of this patent is extended or adjusted under 35 U.S.C. 154(b) by 21 days.

(21) Appl. No.: 14/779,981

(22) PCT Filed: Jun. 25, 2014

(86) PCT No.: PCT/IB2014/001936

§ 371 (c)(1),
(2) Date: Sep. 25, 2015

(87) PCT Pub. No.: WO2015/008149

PCT Pub. Date: Jan. 22, 2015

(65) Prior Publication Data

US 2016/0036115 A1 Feb. 4, 2016

Related U.S. Application Data

(60) Provisional application No. 61/839,064, filed on Jun. 25, 2013.

(51) Int. Cl.
*H01P 7/04* (2006.01)
*H01P 1/205* (2006.01)
(Continued)

(52) U.S. Cl.
CPC ..... *H01P 7/04* (2013.01); *H01P 1/20* (2013.01); *H01P 1/205* (2013.01); *H01P 7/06* (2013.01)

(58) Field of Classification Search
CPC .... H01P 7/04; H01P 1/202; H01P 7/06; H01P 1/205
(Continued)

(56) References Cited

U.S. PATENT DOCUMENTS

2001/0002809 A1* 6/2001 Haapakoski ..... H01P 7/04 333/222
2006/0284708 A1* 12/2006 Reeves ..... H01P 7/04 333/222
2010/0182108 A1* 7/2010 Koreyasu ..... H01P 5/103 333/250

FOREIGN PATENT DOCUMENTS

CN 103022321 A 4/2013
EP 0924790 A1 6/1999
(Continued)

OTHER PUBLICATIONS

"International Application Serial No. PCT/IB2014/001936, International Search Report mailed Feb. 26, 2015", 4 pgs.
(Continued)

*Primary Examiner* — Stephen E Jones
*Assistant Examiner* — Rakesh Patel
(74) *Attorney, Agent, or Firm* — Schwegman Lundberg & Woessner, P.A.

(57) ABSTRACT

A resonator according to the invention includes an Inner conductor. The resonator has a easing comprising walls, a lid and a bottom shell within which there is a resonator cavity. The Inner conductor is in said resonator cavity. The Inner conductor is a conductive material formed with a base portion having a first end and a second end having a first end attached to a surface of the resonator cavity galvanically, in addition, the inner conductor has two or more elongate conductive materials forming resonator parts having a first end and a second end, and the resonator pasts first end is galvanically secured to the base portion at one end and the other end is galvanically separated from the resonator cavity inner surface. The characteristics of the resonator parts are selected so that each produces its own resonance width. These properties Include, for example, size, shape, orientation, material, and their different combinations.

13 Claims, 2 Drawing Sheets

(51) Int. Cl.
*H01P 1/20* (2006.01)
*H01P 7/06* (2006.01)

(58) Field of Classification Search
USPC ..... 333/222–226, 206
See application file for complete search history.

(56) References Cited

FOREIGN PATENT DOCUMENTS

| | | | |
|---|---|---|---|
| EP | 1962369 | A1 | 8/2008 |
| GB | 1218111 | A | 1/1971 |
| WO | WO-9930383 | A2 | 6/1999 |
| WO | WO-2009067056 | A1 | 5/2009 |
| WO | WO-2015008149 | A2 | 1/2015 |
| WO | WO-2015008149 | A3 | 1/2015 |

OTHER PUBLICATIONS

"International Application Serial No. PCT/IB2014/001936, Written Opinion mailed Feb. 26, 2015", 8 pgs.
Lobanov, N, "Two-stub quarter wave superconducting resonator design", Physical Review Special Topics—Accelerators and Beams, vol. 9, No. 4,, (Apr. 1, 2006).
"Chinese Application Serial No. 201480030216.0, Office Action dated Apr. 25, 2017", w English Translation, 18 pgs.

* cited by examiner

RESONATOR STRUCTURE FOR A CAVITY FILTER ARRANGEMENT

This application is a U.S. National Stage Filing under 35 U.S.C. 371 from International Application No. PCT/IB2014/001936, filed Jun. 25, 2014 and published in English as WO 2015/008149 on Jan. 22, 2015, which claims the benefit of priority under 35 U.S.C. 119(e) to U.S. Provisional Patent Application Ser. No. 61/839,064, filed Jun. 25, 2013, each of which is incorporated herein by reference in its entirety.

BACKGROUND OF THE INVENTION

1. Field of the Invention

The invention relates to the inner conductor of the resonator, the resonator comprises a casing, consisting of walls, lid and bottom of the casing resonator cavity in that the inner conductor is arranged to be located in said resonator, and into the resonator cavity, in a resonator cavity which has at least one inner conductor.

2. Description of the Prior Art

Cavity resonators are commonly used for making the filters in telecommunications networks, in particular, when the transmitted signal power is relatively high This is because these losses are due to the small size of resonator filters, which means only a small efficiency signal fade. In addition, the response characteristics are well controllable and adjustable to most stringent specifications, Most of the filters and the filter pass band width of the space are intended to be fixed. In some of the filters the filter passband width is supposed to be constant, but on the pass-band is selected to be contained in a total area. This filter is required in addition to the basic tuning range for the passband transmission. This requires a lot of precise mechanical arrangements, and the adjustment to achieve the correct point.

The cavity resonator's coaxial resonator is shorter, this structure includes the inner conductor, consisting of side walls of the outer conductor, the bottom and the lid. Base and lid are in a galvanic connection with the outer conductor, and all three together forming a closed resonator cavity. In general, the lower end of the inner conductor galvanically linked to the bottom and the upper end of the air, when forming the transmission line resonator is short circuited at its lower end and open at its upper end. Resonant frequency of the resonator depends on the properties. If desired the filter which would be a number of resonance frequencies, it can be obtained by successive coupling of several resonators with different resonant frequencies. Such coordination, however, requires a lot of adjustment in order to achieve the desired frequency bands. Resonance transfer of such a filter is, however, very difficult, because it is taken into account also the links be the resonators.

German patent DE 3812782 shows a resonator, the inner conductor has a piston, which may be moving rapidly into the inner conductor to change the electrical characteristics of change of the resonance. Structure requires mechanics, so it becomes more expensive than conventional resonators of moving parts because it is more prone to defects.

SUMMARY OF THE INVENTION

The aim of the present invention is a solution that can significantly reduce a known technique for disadvantages and drawbacks associated with cavity filters.

The main idea of the invention is to form an inner conductor of the resonator, which resonator produces more simultaneous release strips. This is achieved by forming the inner conductor with a conductive material formed in the base portion, and the ends of which include two or more elongated conductive materials forming a resonator part. The characteristics of the resonator parts are selected so that each produces its own resonance width. These properties include, for example, size, shape, orientation, material, and their different combinations.

According to one embodiment of the resonator, the inner conductor of the resonator includes a casing, consisting of walls, lid and bottom shell and inside the resonator cavity. The inner conductor is arranged to be placed above the resonator cavity. According to a preferred embodiment, the inner conductor is a conductive material formed in the base portion and having a first end and a second end. The first end of the base portion is arranged to be attached to a surface resonator cavity galvanically, i.e., the resonator housing. In addition, the inner conductor has two or more elongated resonator parts of conductive material formed with a first end and a second end. A first end of the resonator part is a galvanic connection of the base portion at one end and the other end providing the galvanic isolation from the resonator cavity's inner surface. The inner conductor may be prepared, for example, by molding or soldering, or may be formed by several elements by attaching them to each other.

A resonator according to the invention in which in one embodiment the inner conductor resonator cavity surface to which the base portion is arranged to be attached, is on the ground.

A resonator inner conductor according to the invention, in another embodiment, in which the inner core is in two parts and one part is arranged to be attached to the opposite surface of the resonator cavity and another part with said base portion. According to the invention, the resonator inner conductor in a third embodiment of the second part of the inner conductor and the base portion have two or more elongate conductive materials forming the resonator part. According to the invention, the inner conductor in one resonator in a fourth embodiment, has the first and second portions located near each other between the resonator parts.

According to the invention, the inner conductor in a fifth embodiment, the same part of the closed position of the resonator parts' longitudinal axes are at least in partially differing directions. In this case, the resonator parts are thus not fully parallel.

According to the invention the inner conductor in one resonator in a sixth embodiment, the longitudinal axes of the resonator parts are straight.

According to the invention the inner conductor in one resonator in a seventh embodiment, at least part of one of the resonator parts is curved. So all resonator part are thus not straight.

According to the invention, the inner conductor in one resonator in an eighth embodiment, a cross-section surface area of the part is up to 30% of the surface area to which it is attached.

According to the invention, the inner conductor in one resonator in a ninth embodiment, the base portion has a height of less than 50% of the height of the resonator cavity. The distance height of the resonator cavity here refers to the surface of the base portion which is connected to the opposite surface of the resonator.

According to the invention, the inner conductor in one resonator in a tenth embodiment, the resonator cavity is substantially parallelogram shaped.

According to the invention, the inner conductor in one resonator in an eleventh embodiment has a cylindrical resonator cavity.

According to the invention, the inner conductor in one resonator in a twelfth embodiment, at least one of the resonator pieces is in the resonator cavity.

According to the invention, the inner conductor in one resonator in a thirteenth embodiment, the resonator part's resonator piece is galvanically connected to the other end. At the resonator piece, the properties of the resonator part can be modified to affect the production of the resonator width.

According to one embodiment of a resonator with a shell, which consists of walls, lid and bottom, inside the casing resonator cavity and the resonator cavity, there is at least one inner conductor.

The advantage of the present invention is that it achieves an arrangement in which the resonator is obtained in the same number of emission bands. The invention has the advantage that it can be reduced by having the resonators use a device with significantly compared to the known technique's corresponding characteristics reached at the device. In addition, the present invention has the advantage that its structure is simple and thus the production cost is reduced and the failure of components and subsystems decreases. Further, the invention enables the reproducible setting of the same settings produce the same results. The invention also has the advantage that, since the resonance frequency of the set is held in place and does not change with time, because the time varying components can be reduced. When the pieces have been set, the active control is not needed.

BRIEF DESCRIPTION OF THE DRAWINGS

The invention will now be described in detail. In the description reference is made to the accompanying drawings, in which.

DETAILED DESCRIPTION OF THE INVENTION

In the following description, the embodiments are exemplary only and the person skilled in the basic idea of the invention can understand it in some other way than described in the specification. Although the description may refer to one embodiment of the embodiments, or in several places, it does not mean that the target is only in regard to a single reference to the described embodiment or feature of the described which would be useful only in conjunction with the illustrated embodiment. Two or more individual features of embodiments can be combined and thus provide novel embodiments of the invention.

Figure 1:
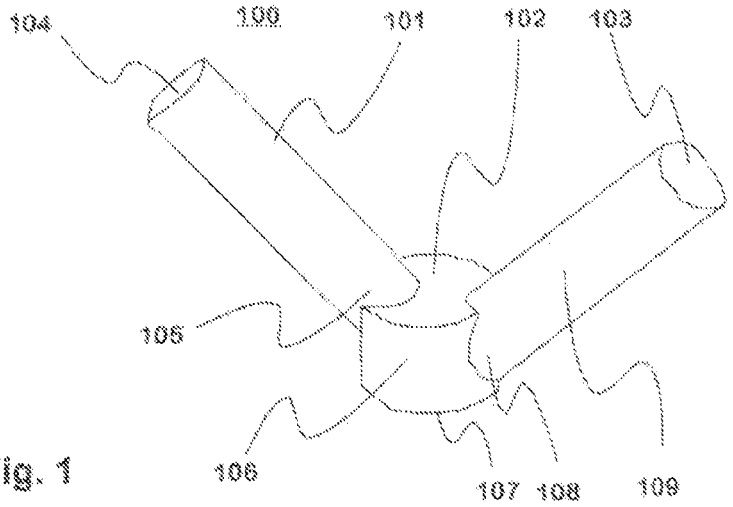
FIG. 1 shows an example of a resonator according to the invention with the inner conductor.

FIG. 1 shows an example of an inner conductor 100 of a resonator 100 according to the invention. The inner conductor 100 includes base 106, which is formed with a conductive material. In this example, the base portion 106 is a cylindrical structure having a first end 107 and a second end 102. The base portion 106 may, of course, be of some other shape, such as, for example a parallelogram, or any other regular geometric form. The first end 107 of the base portion 106 is intended to be attached to an inner surface of a resonator cavity of a resonator housing. That connection is made so that the base portion 106 has a direct electrical connection to the housing, i.e., they are in galvanic contact. The example of FIG. 1 has for the inner conductor 100 two resonator parts: a first resonator part 101 and a second resonator part 109. The resonator parts in this example are elongated rods, and they are formed of a conductive material. The first resonator part 101 has a first end 105 and a second end 104. The second resonator part 109 has a first end 108 and a second end 103. The two first ends of the respective resonator parts are electrically attached to the base portion 106. The resonator parts in this example are located symmetrically about a 46 degree angle to the longitudinal axis of the base portion 106. Positioning of the resonator parts can be made very any different ways. Bonding of the resonator parts can be done in various ways, for example, they can be soldered or welded to or made an opening in the base part 106 and the inner core is molded in a mold. The two second ends 103 and 104 of the resonator parts provide galvanic isolation of the resonator cavity's inner surface, i.e., they have no direct electrical contact with the inner surface of the resonator cavity.

The resonator parts are arranged so that when the inner conductor is in a resonator cavity, each produces a different electronic effect of the resonator, and thereby create two resonance widths. The resonances caused by the resonator parts' different resonance widths can be clearly separated, or they may be adjusted to be adjacent to each other so that they cause in practice a single wider resonance width. The resonator parts may be arranged for example along the lines of different shapes and/or sizes or they may be the same. They may have different electrical properties or else influence the characteristics of the resonance is provided by different combinations of the foregoing. The limited amount of the resonator parts is now two, but they may be more.

Figure 2:
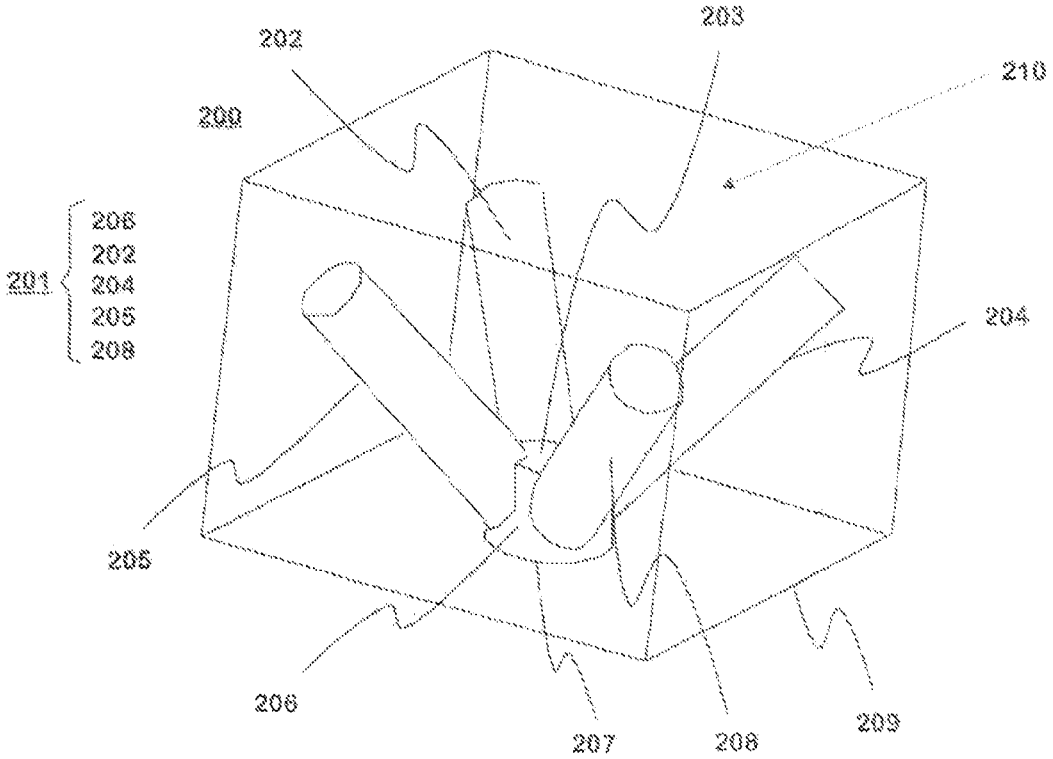
FIG. 2 shows an example of the invention with the resonator and the resonator inner conductor.

FIG. 2 shows an example of a resonator 200 according to the invention, which includes inner conductor 201. The resonator 200 comprises a casing 209, consisting of walls, lid and bottom enclosing the shell-shaped parallelogram resonator cavity with the inner conductor 201 contained therein. The inner conductor 201 includes base portion 206, and four resonator parts: resonator part first 202, second resonator part 204, third resonator part 205 and fourth resonator part 208. The base portion 206 is cylindrical and has a first end 207 and a second end 203. The first end 207 is connected electrically to the conductive resonator casing 209 at the bottom of the inner conductor of the resonator, i.e., in galvanic contact with the casing. The resonator parts 202/204/205/208 are closed at one end of the base portion 206 so that the other ends thereof have galvanic isolation with respect to the casing 209. The resonator parts in this example are located symmetrically. The resonator parts' effects on the operation of the resonator electrical properties are chosen so that each produces its own resonance width. These may be separated from the frequency domain or the wider strips. The properties of the resonator parts are determined by the nature of the resonator characteristics as needed.

Figure 3:
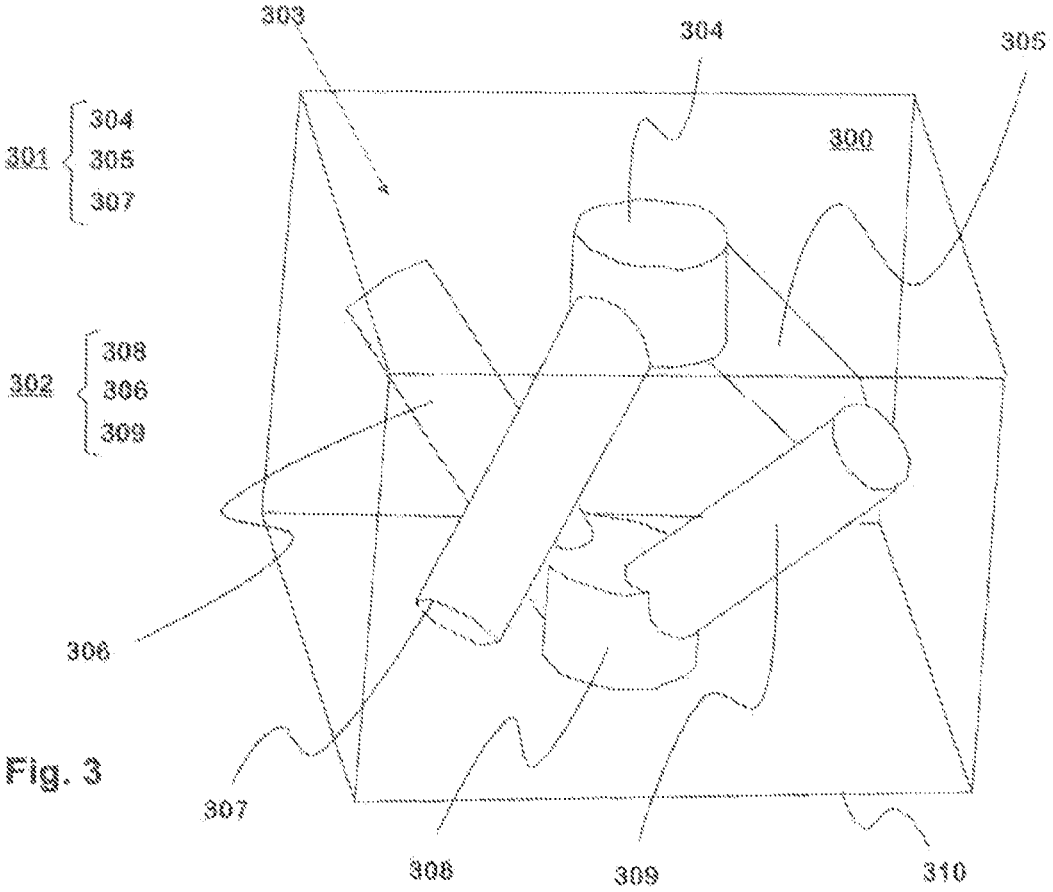
FIG. 3 shows a second example according to the invention with the resonator and the resonator inner conductor.

FIG. 3 is a view of another example of a resonator 300 according to the invention, which includes an inner conductor of the present invention. The resonator 300 includes a casing 310 that is a shield and establishes a resonance cavity 303. This example differs from the example in FIG. 2 in that the inner conductor is in two parts, a first inner conductor pan 302 and a second inner conductor part 301. The first part 302 of the inner conductor includes a base portion 308 and two resonator parts: a first resonator part 306 and a second resonator part 309. The second part 301 of the inner conductor includes a base portion 304 and two resonator parts: a first resonator part 307 and a second resonator part 305. The first and second inner conductor parts of this example are similar to those described in FIG. 1, with respect to the inner conductor 100. The base portion 308 of the first inner conductor pad 302 is connected to a surface of the resonator cavity 303. The base portion 304 of the second inner conductor part 301 is connected to a surface of the resonator cavity 303. The inner conductor parts 301 and 302 are disposed in such a way that the various components are mutually resonant therebetween. The parts of the inner conductor can be a different number of resonator parts. Parts of the inner conductor need not be symmetrical. It is also possible that the second part of the inner conductor is a traditional inner conductor.

Figure 4:
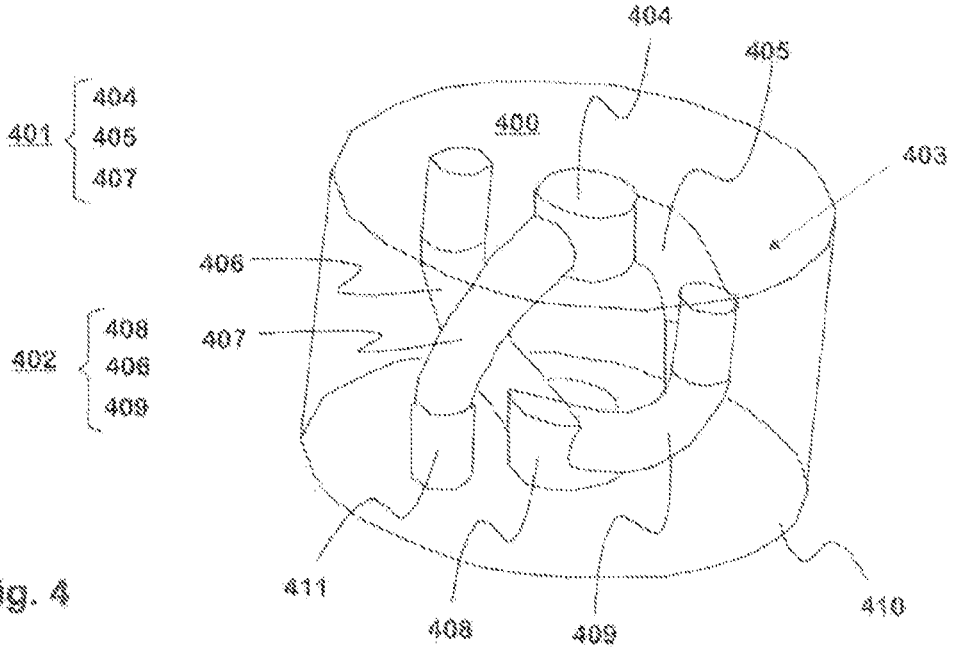
FIG. 4 shows a third example according to the invention with the resonator and the resonator inner conductor.

FIG. 4 shows a third example of a resonator 400 according to the invention, which is one of the inner conductor of the present invention. The resonator 400 includes a casing 410 that is a shield and that establishes a resonance cavity 403. An inner conductor includes a first inner conductor part 402 and a second inner conductor part 401. The first part 402 includes a base portion 408 and two resonator parts: a first resonator part 406 and a second resonator part 409. The second part 401 includes a base portion 404 and two resonator parts: a first resonator part 407 and a second resonator part 405. This example differs from the example of FIG. 3 in that the resonator parts of the resonator cavity are cylindrical and are curved. In addition, the resonator parts' other ends 411 are support pieces joined to the casing 410. The support pieces of the ends 411 are non-conductive. The second ends of the resonator part's interval resonator piece can be placed where desired, which can be further modified by the resonator part's electrical properties. The resonator piece can of course be formed without a support piece in the resonator part. The resonator piece need not be away from the resonator part.

There need not be resonator pieces in all resonator parts. If the resonator has the same number of resonator parts their properties can be varied.

An arrangement in accordance with the present invention may be one with multiple resonances of the resonance cavity. This makes it possible to reduce the resonators consisting of equipment and reduce their parts. Studies have shown the invention resonators Q-values remain good.

Having described the invention in accordance with certain preferred embodiments. The present invention is not limited to the solutions just described, but the inventive idea can be applied in numerous ways within the limits of the appended claims.

What is claimed is:

1. A resonator comprising a casing with walls, a lid and a bottom forming a resonator cavity, an inner conductor arranged to be located in said resonator cavity, wherein the inner conductor is a conductive material formed with a base portion having a first end and a second end, the first end of the base portion is arranged to be attached electrically to a surface of the casing in the resonator cavity, and two conductive elongated resonator parts having respective third and fourth and fifth and sixth ends, wherein the respective third and fifth ends of the two conductive elongated resonator parts are in galvanic connection with the second end of the base portion and the respective fourth and sixth ends of the two conductive elongated resonator parts are galvanically isolated from an inner surface of the resonator cavity, and wherein the base portion has a height of less than 50% of a height of the resonator cavity.

2. The resonator as claimed in claim 1, wherein the first end of the base portion of the inner conductor is attached to the bottom of the casing.

3. The resonator as claimed in claim 1, wherein at least one conductive elongated resonator part of the two conductive elongated resonator parts includes a resonator piece.

4. The resonator as claimed in claim 3, wherein the resonator piece is galvanically connected to at least one of the two conductive elongated resonator parts at one of the fourth or sixth ends of the two conductive elongated resonator parts, respectively.

5. The resonator as claimed in claim 1, wherein the resonator cavity is substantially parallelogram shaped.

6. The resonator as claimed in claim 1, wherein longitudinal axes of the two conductive elongated resonator parts are attached to the base portion in at least partially differing directions.

7. The resonator as claimed in claim 1, wherein axes of the two conductive elongated resonator parts are straight longitudinal axes.

8. The resonator as claimed in claim 1, wherein at least one of the two conductive elongated resonator parts is curved.

9. The resonator as claimed in claim 1, wherein the base portion extends across a surface area of up to 30% of a surface area of the surface of the casing to which the first end of the base portion is attached.

10. The resonator as claimed in claim 1, wherein the resonator cavity is cylindrical.

11. A resonator comprising a casing with walls, a lid and a bottom forming a resonator cavity, an inner conductor arranged to be located in said resonator cavity, wherein the inner conductor is a conductive material formed with a first base portion having a first end and a second end, the first end of the first base portion being arranged to be attached electrically to a surface of the casing in the resonator cavity, first and second conductive elongated resonator parts having respective third and fourth and fifth and sixth ends, and the third and fifth ends of the first and second conductive elongated resonator parts being in galvanic connection with the second end of the first base portion and the fourth and sixth ends of the first and second conductive elongated resonator parts being galvanically isolated from an inner surface of the resonator cavity, a second base portion having a seventh end and a eighth end, the seventh end of the second base portion is arranged to be attached electrically to a further surface of the casing in the resonator cavity, and third and fourth conductive elongated resonator parts having respective ninth and tenth and eleventh and twelfth ends, the ninth and eleventh ends of the third and fourth conductive elongated resonator parts being in galvanic connection with the eighth end of the second base portion and the tenth and twelfth ends of the third and fourth conductive elongated resonator parts being galvanically isolated from an inner surface of the resonator cavity, wherein the seventh end of the second base portion is arranged to be attached to the casing within the resonator cavity at a location opposite to the surface to which the first base portion is attached.

12. The resonator as claimed in claim 11, wherein the first and second base portions and the first, second, third and fourth elongated conductive resonator parts are mutually resonant.

13. The resonator as claimed in claim 11, wherein the first and second conductive elongated resonator parts are located between the third and fourth conductive elongated resonator parts.

* * * * *